US010756468B2

(12) United States Patent
Liao et al.

(10) Patent No.: US 10,756,468 B2
(45) Date of Patent: Aug. 25, 2020

(54) PLUG CONNECTOR ASSEMBLY, FLEXIBLE FLAT CABLE ASSEMBLY THEREOF, AND FLEXIBLE FLAT CABLE THEREOF

(71) Applicant: BELLWETHER ELECTRONIC CORP., Taoyuan (TW)

(72) Inventors: Yen-Jang Liao, Taoyuan (TW); Jie-Yau Tan, Kaohsiung (TW)

(73) Assignee: BELLWETHER ELECTRONIC CORP., Taoyuan (TW)

( * ) Notice: Subject to any disclaimer, the term of this patent is extended or adjusted under 35 U.S.C. 154(b) by 0 days.

(21) Appl. No.: 16/675,131

(22) Filed: Nov. 5, 2019

(65) Prior Publication Data

US 2020/0144752 A1 May 7, 2020

(30) Foreign Application Priority Data

Nov. 7, 2018 (TW) ..... 107215142 U
Jan. 7, 2019 (CN) ..... 2019 1 0012225

(51) Int. Cl.

| | |
|---|---|
| ***H01R 3/00*** | (2006.01) |
| ***H01R 12/77*** | (2011.01) |
| ***H01R 13/627*** | (2006.01) |
| ***H01R 12/62*** | (2011.01) |
| ***H01R 13/50*** | (2006.01) |
| ***H01R 12/61*** | (2011.01) |

(52) U.S. Cl.

CPC ..... *H01R 12/775* (2013.01); *H01R 12/61* (2013.01); *H01R 12/62* (2013.01); *H01R 12/774* (2013.01); *H01R 13/50* (2013.01); *H01R 13/6272* (2013.01)

(58) Field of Classification Search

CPC .. H01R 9/0742; H01R 9/0735; H01R 9/0714; H01R 23/664

USPC ..... 439/492, 491, 496, 493, 495, 499

See application file for complete search history.

(56) References Cited

U.S. PATENT DOCUMENTS

| | | | | |
|---|---|---|---|---|
| 7,238,044 | B2 * | 7/2007 | Uchida | H01R 12/79 439/492 |
| 7,520,774 | B2 * | 4/2009 | Watanabe | H01R 9/037 439/260 |
| 7,993,151 | B2 * | 8/2011 | Chuo | H01R 12/88 439/260 |
| 8,172,610 | B2 * | 5/2012 | Kurachi | H01R 12/79 439/578 |
| 8,550,849 | B2 * | 10/2013 | Yamaji | H01R 13/6581 439/495 |

(Continued)

*Primary Examiner* — Phuong Chi Thi Nguyen

(74) *Attorney, Agent, or Firm* — Li & Cai Intellectual Property Office

(57) ABSTRACT

A plug connector assembly includes an insulated housing, and a flexible flat cable assembly. The flexible flat cable assembly includes a first flat cable, a second flat cable, and a reinforced board. The reinforced board is sandwiched between the first flat cable the second flat cable. An inner shielding layer is disposed between conductors of the first flat cable and the reinforced board, and between conductors of the second flat cable and the reinforced board, respectively. A positioning plate protrudes outward from each of two sides of the reinforced board. The insulated housing has a displacement-preventing mechanism formed on an inner side thereof for blocking the positioning plate, so as to limit the displacement of the reinforced board along the inserting direction.

20 Claims, 17 Drawing Sheets

(56) References Cited

U.S. PATENT DOCUMENTS 8,553,648 B2 * 10/2013 Lee ..... H04L 5/001
370/331
8,608,509 B2 * 12/2013 Shimada ..... H01R 12/774
439/607.01
8,858,249 B2 * 10/2014 Honda ..... H01R 13/648
439/260
8,888,534 B2 * 11/2014 Toda ..... H01R 12/7023
439/630

* cited by examiner

PLUG CONNECTOR ASSEMBLY, FLEXIBLE FLAT CABLE ASSEMBLY THEREOF, AND FLEXIBLE FLAT CABLE THEREOF

CROSS-REFERENCE TO RELATED PATENT APPLICATION

This application claims the benefit of priority to Taiwan Patent Application No. 107215142, filed on Nov. 7, 2018 and China Patent Application No. 201910012225.1, filed on Jan. 7, 2019. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a plug connector assembly, a flexible flat cable assembly thereof, and a flexible flat cable thereof, and more particularly to a plug connector assembly being inserted in a socket and able to transmit signals.

BACKGROUND OF THE DISCLOSURE

Electrical connectors have been widely used to transmit signals or electrical power. As sizes of the electrical connectors have decreased and demand for faster signal transmitting speed have increased, some transmitting conductors of the electrical connectors have been designed to be disposed on printed circuit boards (i.e., card-edge connectors). However, a manufacturing process of a card-edge connector disposed on a printed circuit board is complicated, time-consuming, and costly.

In addition, after the printed circuit board is manufactured, the printed circuit board is required to be connected to a cable so as to transmit signals or electrical power. However, even if the printed circuit board and the cable are respectively compliant with requirements of impedance matching, an assembling process of the printed circuit board and the cable would result in some impedance mismatching. To reduce an occurrence of the impedance mismatching, more studies on materials of assembling media and an increased accuracy upon the assembling process are needed. As a result, a production cost is increased.

Furthermore, power consumption of equipment connected to the electrical connectors has increased. Phenomena such as sparking or electric arcing (i.e., arc discharge) may occur while hot-plugging the electrical connectors, which may result in damage to components of the equipment.

SUMMARY OF THE DISCLOSURE

In response to the above-referenced technical inadequacies, the present disclosure provides a plug connector assembly, which includes a reinforced board and a protective member. The reinforced board can increase the strength of the flexible flat cable assembly, and the protective member can protect the front end of the flexible flat cable assembly, so that it can reduce the damage problems due to mating and unmating with the socket connector, simplify the process of manufacturing transmitting conductors of electrical connectors, and easily achieve the impedance matching. The reinforced board and the protective member can be assembled by two pieces or integrated into one piece, which can cooperate with different manufacturing processes, so that it can achieve the effects of simplifying the manufacturing process.

In response to the above-referenced technical inadequacies, the present disclosure further provides a plug connector assembly with a reinforced board, which can be metal material or have a metal layer with shielding effects for enhancing the quality of transmitting high-frequency signals. The flexible flat cable assembly includes an inner shielding layer. The inner shielding layer can electrically contact the reinforced board for better shielding effects.

In response to the above-referenced technical inadequacies, the present disclosure further provides a flexible flat cable, which can be used as a flexible flat cable assembly of the plug connector assembly. Contacting terminals can be designed with different lengths according to the requirements, so that differential signal conductors are located behind the grounding conductor, to achieve the design requirement of different contact sequence. If there is electric arcing, the electric arc is first transmitted to the non-signal conductor, and will not be transmitted to the signal conductor, wherein the signal conductor is used to transmit signal, and the non-signal conductor is used to transmit electrical power or for grounding. The present disclosure therefore can prevent the conductors or elements of the equipment from being damaged by the electrical arcing occurred by the point discharge during hot-plugging.

In one aspect, the present disclosure provides a plug connector assembly, which includes an insulated housing, a flexible flat cable assembly, and a protective member. The insulated housing includes a top wall, a bottom wall and a pair of side walls cooperatively surrounding and forming a receiving space therein along an inserting direction. The flexible flat cable assembly includes a first flat cable, a second flat cable, and a reinforced board. The first flat cable and the second flat cable respectively include a plurality of conductors exposed from the front end of the insulated housing. The reinforced board is sandwiched between the first flat cable and the second flat cable. The reinforced board is a metal board. The front edge of the reinforced board extends beyond front edges of the first flat cable and the second flat cable. The protective member is fixedly disposed on the front edge of the reinforced board. A top surface of the protective member juts from or is flush with the conductors of the first flat cable. A bottom surface of the protective member juts from or is flush with the conductors of the second flat cable.

In one aspect, the present disclosure provides a plug connector assembly, which includes an insulated housing, and a flexible flat cable assembly. The insulated housing includes a top wall, a bottom wall and a pair of side walls cooperatively surrounding and forming a receiving space therein. The flexible flat cable assembly includes a first flat cable, a second flat cable, and a strengthened unit. The first flat cable and the second flat cable respectively include a plurality of conductors that are exposed from the front end of the insulated housing to form a plurality of contacting portions. The first flat cable further includes a covering portion. The conductors of the first flat cable include at least one grounding conductor and at least one pair of differential signal conductors. The covering portion covers front ends of the differential signal conductors, so that a distance between the front edge of the contacting portion of the differential signal conductor and the front edge of the first flat cable is larger than a distance between the front edge of the contacting portion of the grounding conductor and the front edge of the first flat cable. The strengthened unit includes a board-shaped strengthened portion and a protective portion. The first flat cable is disposed on one side of the strengthened portion. The second flat cable is disposed on the other side of the strengthened portion. A top surface of the protective portion juts from or is flush with the conductors of the first flat cable. A bottom surface of the protective portion juts from or is flush with the conductors of the second flat cable.

In one aspect, the present disclosure provides a flexible flat cable for a plug connector assembly. The plug connector assembly includes an insulated housing and a flexible flat cable assembly. The flexible flat cable assembly includes a flat cable. The flat cable is disposed on a reinforced board. A protective member is disposed on a front edge of the reinforced board. The flexible flat cable is used to form the flat cable. The flexible flat cable includes an insulated containing layer, and a plurality of conductors. The insulated containing layer covers the conductors. The conductors are exposed from an end of the flexible flat cable so as to form a contacting portion. The contacting portion includes a contacting surface and an embedded surface. The embedded surface is carried in the insulated containing layer. The conductors include a pair of differential signal conductors and a grounding conductor. The insulated containing layer includes a covering portion. The covering portion covers a front end of the differential signal conductor, so that a distance between a front edge of the contacting portion of the differential signal conductor and a front edge of the flexible flat cable being larger than a distance between a front edge of the grounding conductor and a front edge of the flexible flat cable. An outer shielding layer is disposed on a top side of the insulated containing layer, and an inner shielding layer disposed on a bottom side of the insulated containing layer. The outer shielding layer and the inner shielding layer respectively have an insulated layer on an outer side thereof.

Therefore, the present disclosure has advantages as follows. The present disclosure provides the plug connector assembly, which uses the conductors of the flat cable to electrically connect the terminals of the socket connector. The flexible flat cable assembly includes a reinforced board and a protective member. When the reinforced board is a metal board, it has functions of not only shielding, but also enhancing structural strength of the flexible flat cable assembly. The protective member can protect the conductors of the flexible flat cable assembly during mating and unmating processes. The present disclosure further can prevent conductors or elements of equipment from being damaged by the electric arcing phenomenon of point discharge during hot-plugging. Therefore, the present disclosure can reduce the damaging problems during the mating or unmating with the socket connector, and simplify the process of manufacturing the transmitting conductors of the electrical connector. The present disclosure can replace conventional edge connectors of printed circuit boards, soldered terminal, or insulation-displacement contact (IDC), and more easily process to achieve impedance matching. In addition, the plug connector assembly of the present disclosure is suitable for transmitting high-frequency signals.

These and other aspects of the present disclosure will become apparent from the following description of the embodiment taken in conjunction with the following drawings and their captions, although variations and modifications therein may be effected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
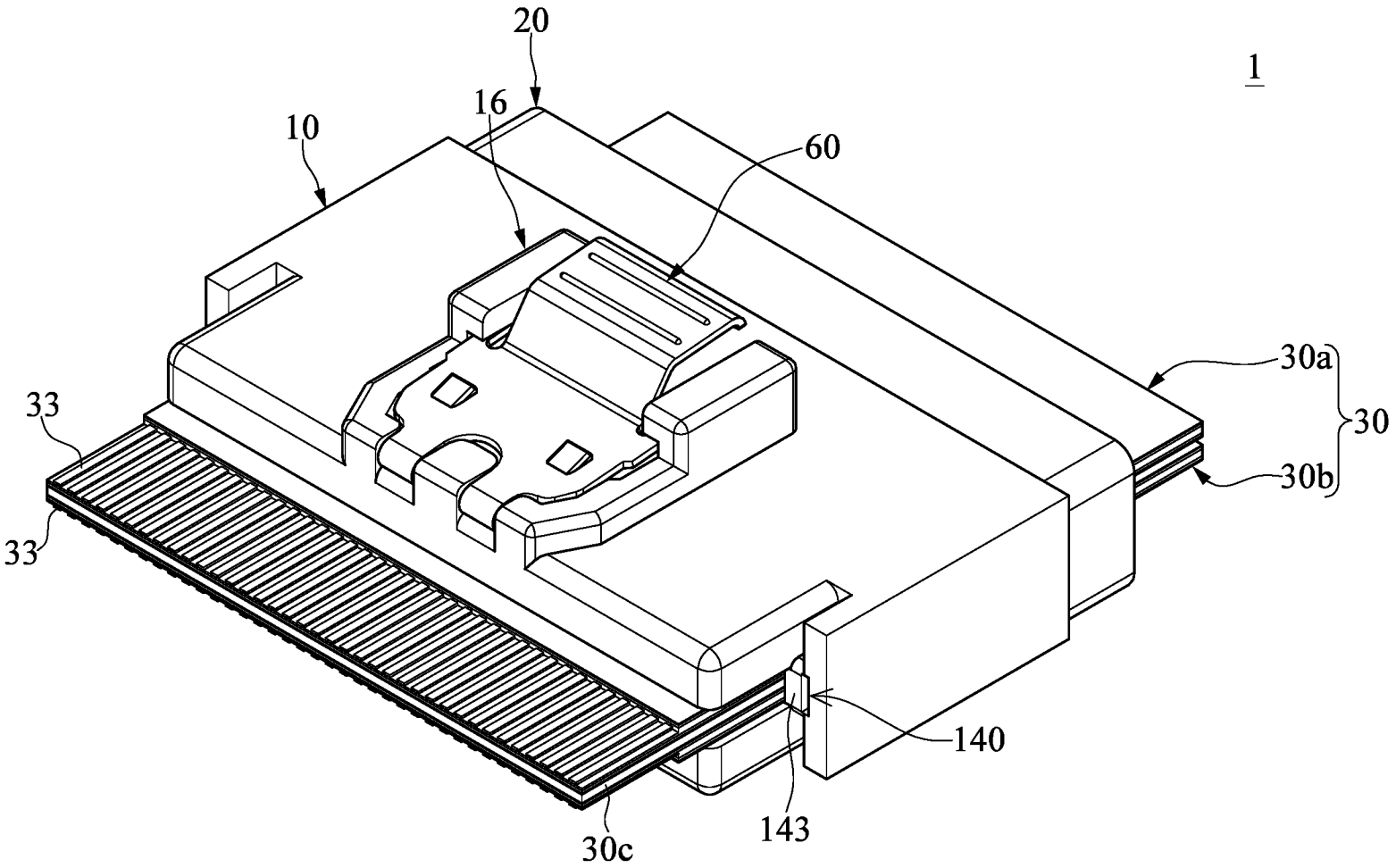
FIG. 1 is an assembled perspective view of a plug connector assembly of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of “a”, “an”, and “the” includes plural reference, and the meaning of "in" includes "in" and "on". Titles or subtitles can be used herein for the convenience of a reader, which shall have no influence on the scope of the present disclosure.

First Embodiment

Figure 2:
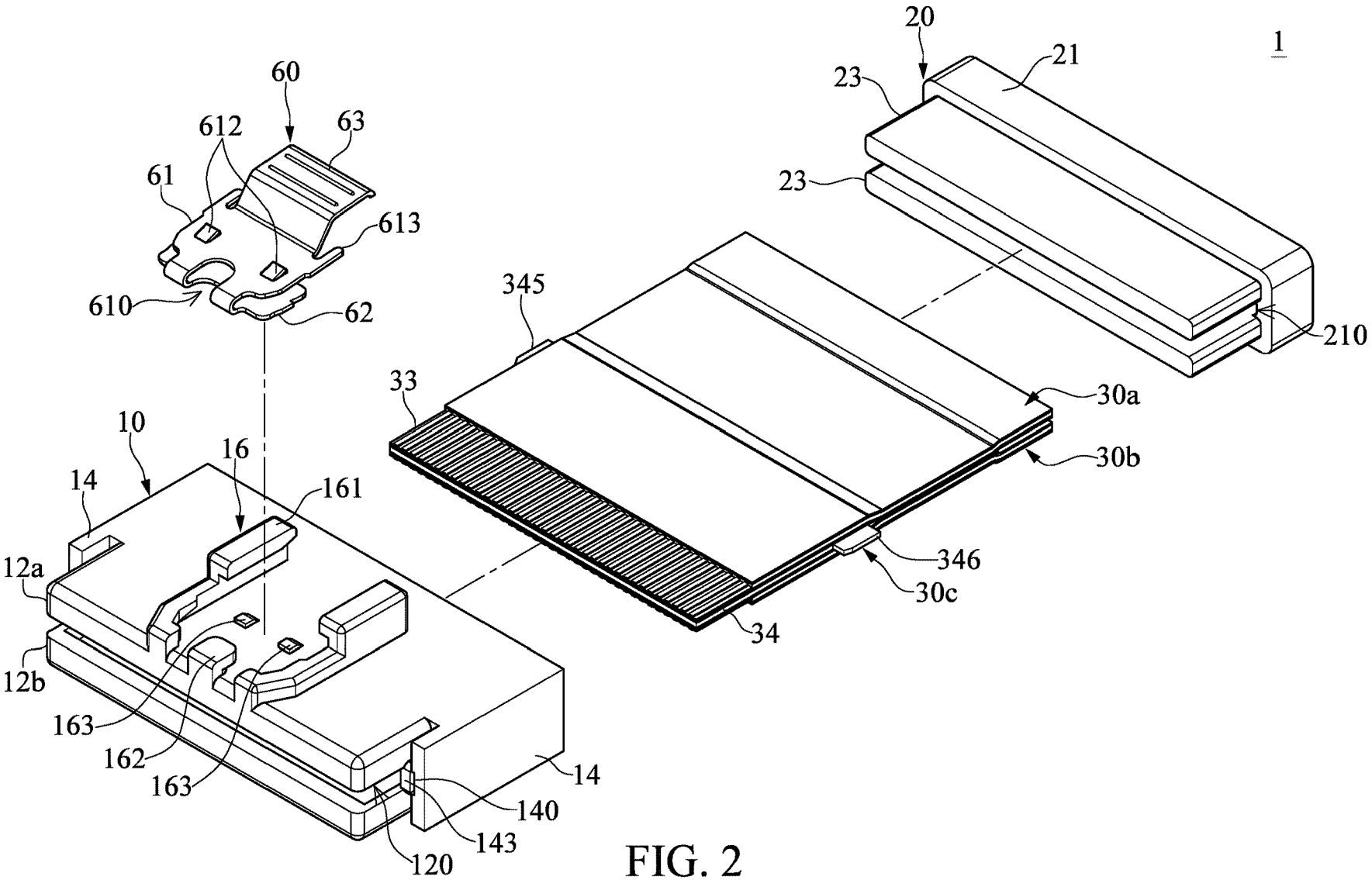
FIG. 2 is an exploded view of the plug connector assembly of the present disclosure.

Reference is made to FIG. 1 to FIG. 2, which is an assembled perspective view and an exploded view of a plug connector assembly according to the present disclosure. The present disclosure provides a plug connector assembly 1, which can be inserted into a socket along an inserting direction (not shown). The plug connector assembly 1 includes an insulated housing 10, a retainer 20, a flexible flat cable assembly 30, and a handle 60. The insulated housing 10 forms a receiving space 120 therein. The flexible flat cable assembly 30 is retained in a main body 210 of the retainer 20. The flexible flat cable assembly 30 has conductors 33 which are exposed from a front end of the retainer 20. The handle 60 is mounted on a top surface of the insulated housing 10, which can be locked to the socket or to unlock the plug connector assembly from the socket.

Reference is made to FIG. 2. The insulated housing 10 includes a top wall 12*a*, a bottom wall 12*b* and a pair of side walls 14. The pair of side walls 14 are respectively connected to the top wall 12*a* and the bottom wall 12*b*, so as to surround and define the receiving space 120. The insulated housing 10 is preferably made of insulated material, such as plastic. The receiving space 120 passes through the insulated housing 10 along the inserting direction and is open to the front and rear ends of the insulated housing 10, respectively.

The retainer 20 includes a main body 21 and a pair of extending walls 23. The handle 60 is fixed on the top wall 12*a* of the insulated housing 10. In this embodiment, the top wall 12*a* of the insulated housing 10 forms a mounting structure 16. The mounting structure 16 restricts the forward, rearward, and upward displacements of the handle 60. However, the present disclosure can omit the handle 60, and can be fixed to the socket connector by the insulated housing 10 in an interference manner.

Reference is made to FIG. 2. In this embodiment, the flexible flat cable assembly 30 includes a first flat cable 30*a*, a second flat cable 30*b*, and a reinforced board 30*c*. The first flat cable 30*a* and the second flat cable 30*b* respectively include a plurality of conductors 33, which are exposed from the front end of the insulated housing 10. The reinforced board 30*c* is sandwiched between the first flat cable 30*a* and the second flat cable 30*b*. A rear end of the reinforced board 30*c* is proximate to a front end of the retainer 20. The retainer 20 retains the first flat cable 30*a* and the second flat cable 30*b* in the main body 210, and a front of the retainer 20 is partially inserted in the receiving space 120 of the insulated housing 10.

Second Embodiment

Figure 4:
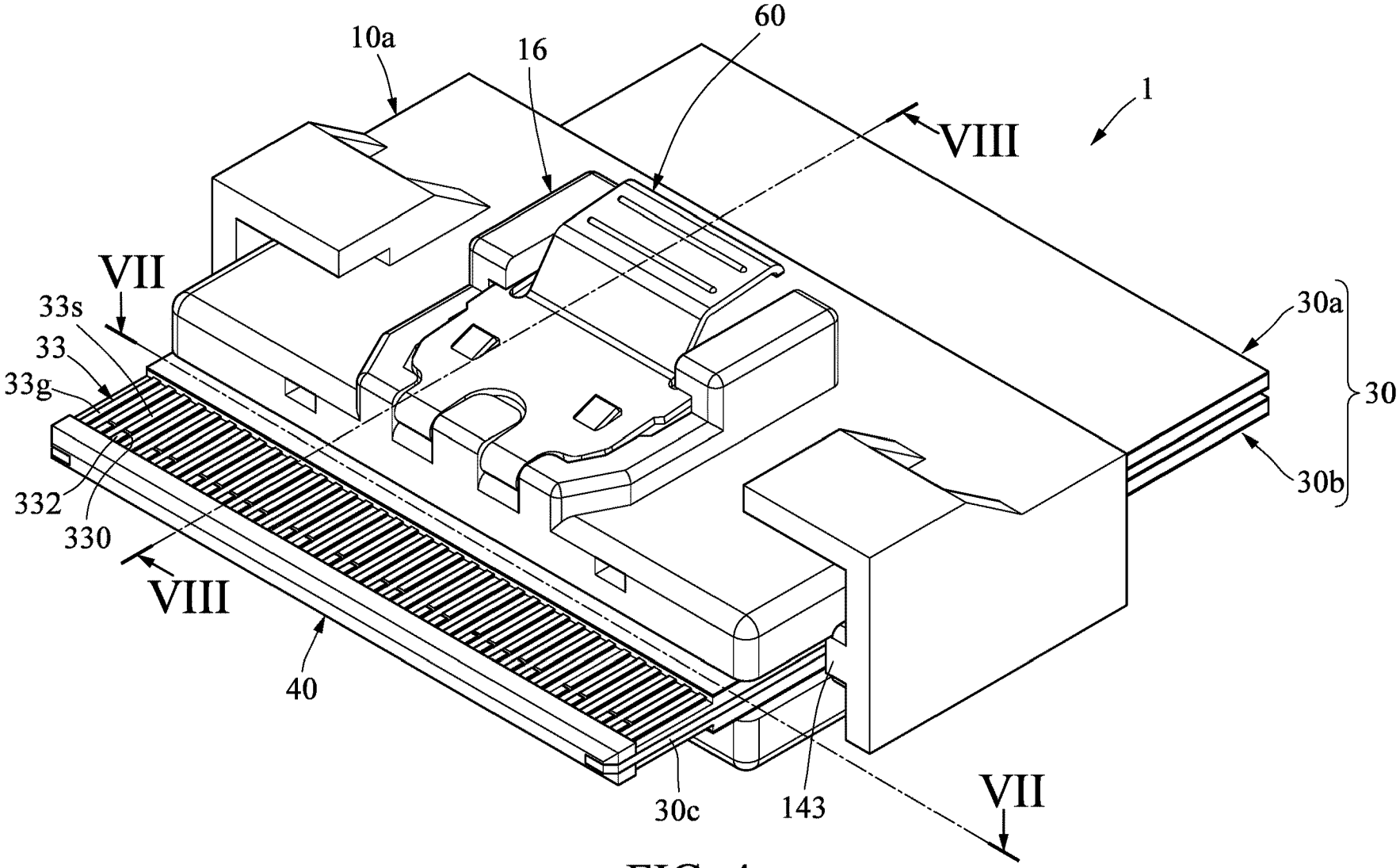
FIG. 4 is an assembled perspective view of the plug connector assembly of a second embodiment of the present disclosure.
Figure 5:
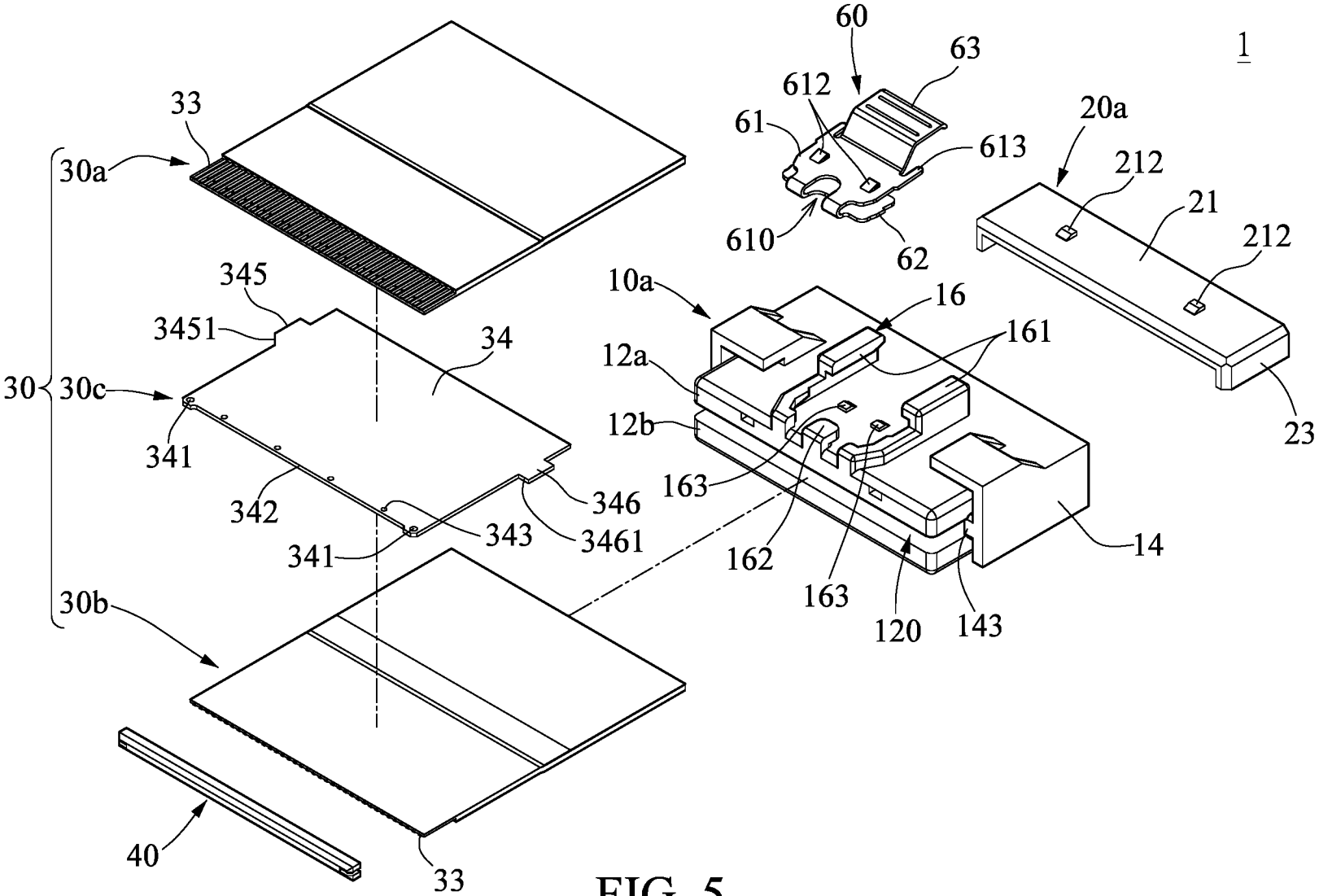
FIG. 5 is an exploded perspective view of the plug connector assembly of the second embodiment of the present disclosure.

Reference is made to FIG. 4 and FIG. 5, which is an assembled perspective view and an exploded view of the plug connector assembly. In this embodiment, the plug connector assembly 1 can be inserted into a socket (not shown) along the inserting direction, and includes an insulated housing 10*a*, a retainer 20*a*, a flexible flat cable assembly 30, a protective member 40, and a handle 60.

Figure 6:
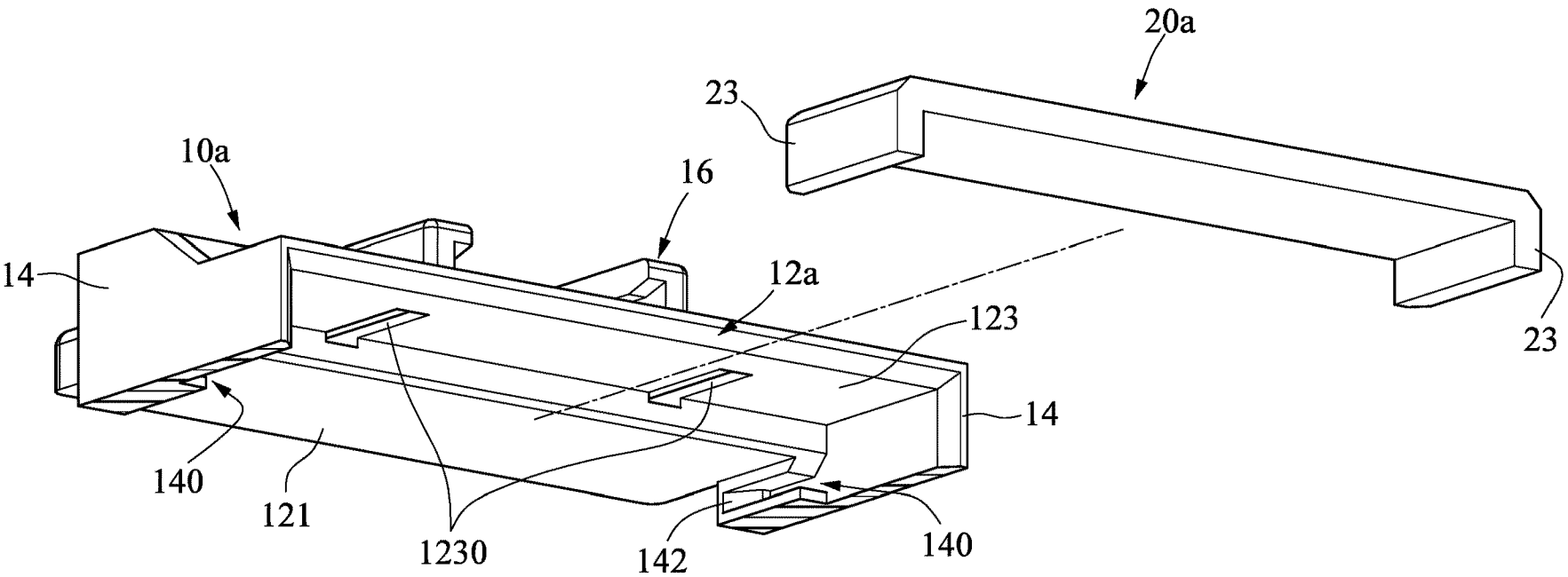
FIG. 6 is a perspective view of an insulated housing and a retainer of the present disclosure.
Figure 7:
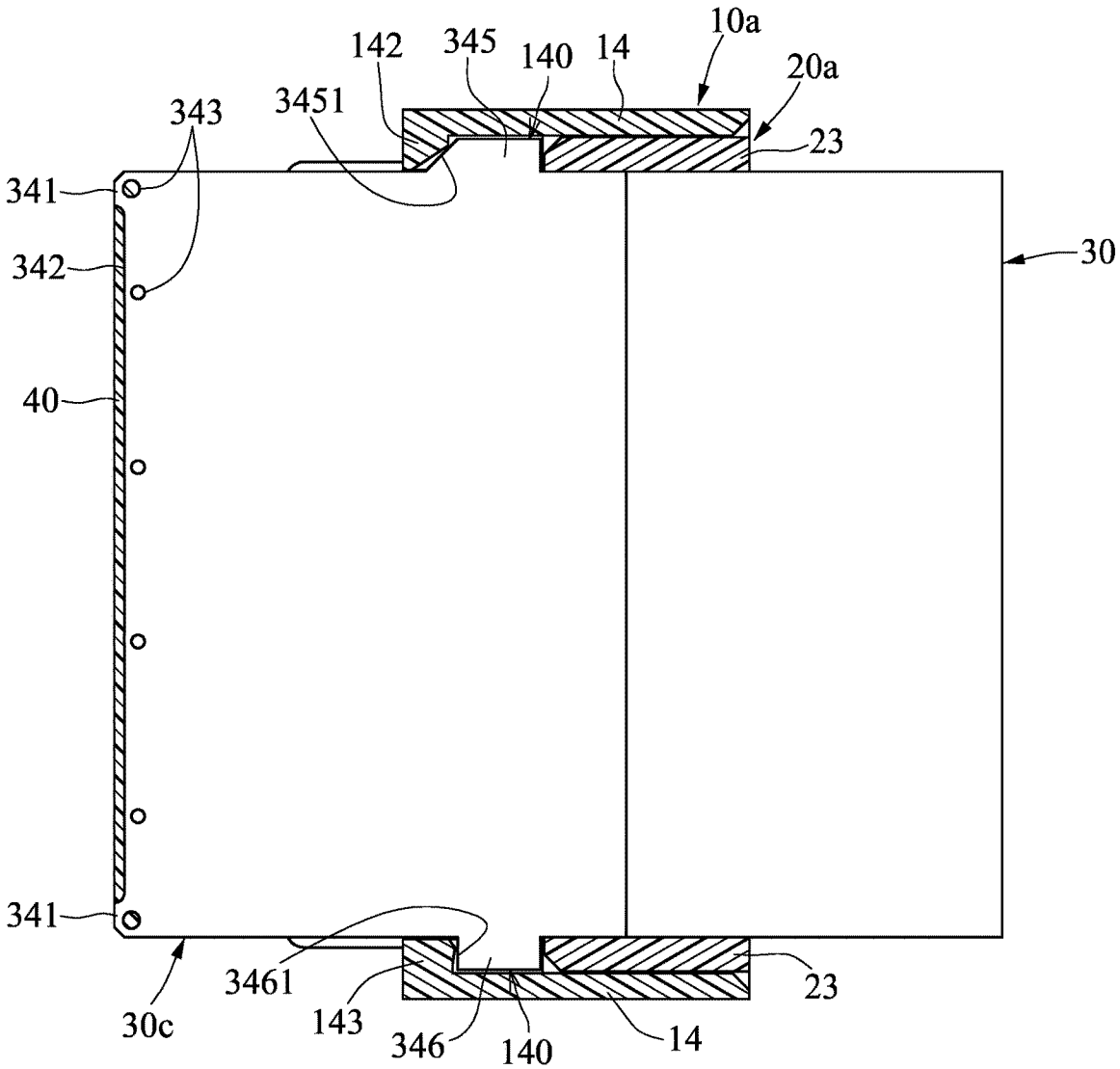
FIG. 7 is a cross-section view along the line VII-VII in FIG. 4 of the present disclosure.

As shown in FIG. 6 and FIG. 7, the insulated housing 10*a* forms a receiving space 120 therein. The flexible flat cable assembly 30 is retained in the insulated housing 10*a*, and includes a plurality of conductors 33 which are exposed from a front end of the retainer 20*a*. The retainer 20*a* is inserted into the receiving space 120 from the insulated housing 10*a*, so that the flexible flat cable assembly 30 can be fixed to the insulated housing 10*a*, and prevents the flexible flat cable assembly 30 from displacement. The cables of the flexible flat cable assembly 30 pass through the receiving space 120 and extend to a rear end of the insulated housing 10*a*. The handle 60 is disposed at a top surface of the insulated housing 10*a*, which is used to lock the plug connector to the socket or unlock from the socket. The elements of the plug connector assembly 1 are introduced in detail.

Reference is made to FIG. 5. The insulated housing 10*a* includes a top wall 12*a*, a bottom wall 12*b* and a pair of side walls 14. The pair of side walls 14 respectively connects to two sides of the top wall 12*a* and the bottom wall 12*b*, so as to surround and form the receiving space 120. The insulated housing 10*a* is preferably made of insulated material, such as plastic. The receiving space 120 passes through the insulated housing 10*a* along the inserting direction and is open to the front and rear ends of the insulated housing 10*a*, respectively.

As shown in FIG. 5 and FIG. 6, the top wall 12*a* of the insulated housing 10*a* forms two engaging slots 1230 on an inner side thereof, and the main body 21 of the retainer 20*a* has two engaging protrusions 212. The engaging slots 1230 correspond with the engaging protrusions 212 in quantity and in position. The engaging protrusions 212 are engaged in the engaging slots 1230, so that the retainer 20*a* is fixed in the insulated housing 10*a*. In detail, the top wall 12*a* of the insulated housing 10*a* includes a front section 121 and a rear section 123. A thickness of the front section 121 is thicker than a thickness of the rear section 123, and forms a height discrepancy.

Reference is made to FIG. 5. One primary feature of the present disclosure is utilizing the flexible flat cable assembly 30 to transmit signal or electric power. The flexible flat cable assembly 30 includes a first flat cable 30*a*, a second flat cable 30*b*, and a reinforced board 30*c*. In this embodiment, the flat cable is FFC (Flexible Flat Cable), which is a flat-shaped cable usually including a flat and flexible insulated film base (such as PET), with multiple flat metallic conductors bonded to one surface by pressing and bonding. The first flat cable 30*a* and the second flat cable 30*b* respectively include a plurality of conductors 33 exposed from one front end of the insulated housing 10*a*. The reinforced board 30*c* is sandwiched between the first flat cable 30*a* and the second flat cable 30*b*, so as to reinforce the structural strength of the flexible flat cable assembly 30. In this embodiment, the reinforced board 30*c* is a metallic board, a front edge of the reinforced board 30*c* is extended beyond the front edge of the first flat cable 30*a* and the second flat cable 30*b*.

In this embodiment, the reinforced board 30*c* can be a metal board, for example, stainless steel, which can prevent the first and second flat cables 30*a* 30*b* from signal interference. However, this present disclosure is not limited thereto. In another embodiment, when cooperating with a different flat cable structure, the reinforced board can be manufactured insulated material, details of which will be provided later. In this embodiment, a thickness of the reinforced board 30*c* is about 0.3 mm to 0.4 mm. In this embodiment, the reinforced board 30*c* is made of stainless steel with the above-mentioned thickness, which can provide the flexible flat cable assembly with sufficient structural strength during mating or unmating processes. In addition, the present disclosure can use an FFC, which is compliant with impedance matching and high-frequency requirements, to directly assemble the flexible flat cable assembly, so as to solve the mismatch due to the assembling. Specifically, according to the requirements of impedance matching, the width of the conductor 33 can be 0.25 mm to 0.5 mm. For example, when the width of the conductor 33 is 0.25 mm to 0.3 mm, the differential pair impedance of the signal conductor can be matched with 100 ohms. When the width of the conductor 33 is between 0.3 mm to 0.5 mm, the differential pair impedance can be matched with 80 ohms.

Figure 3:
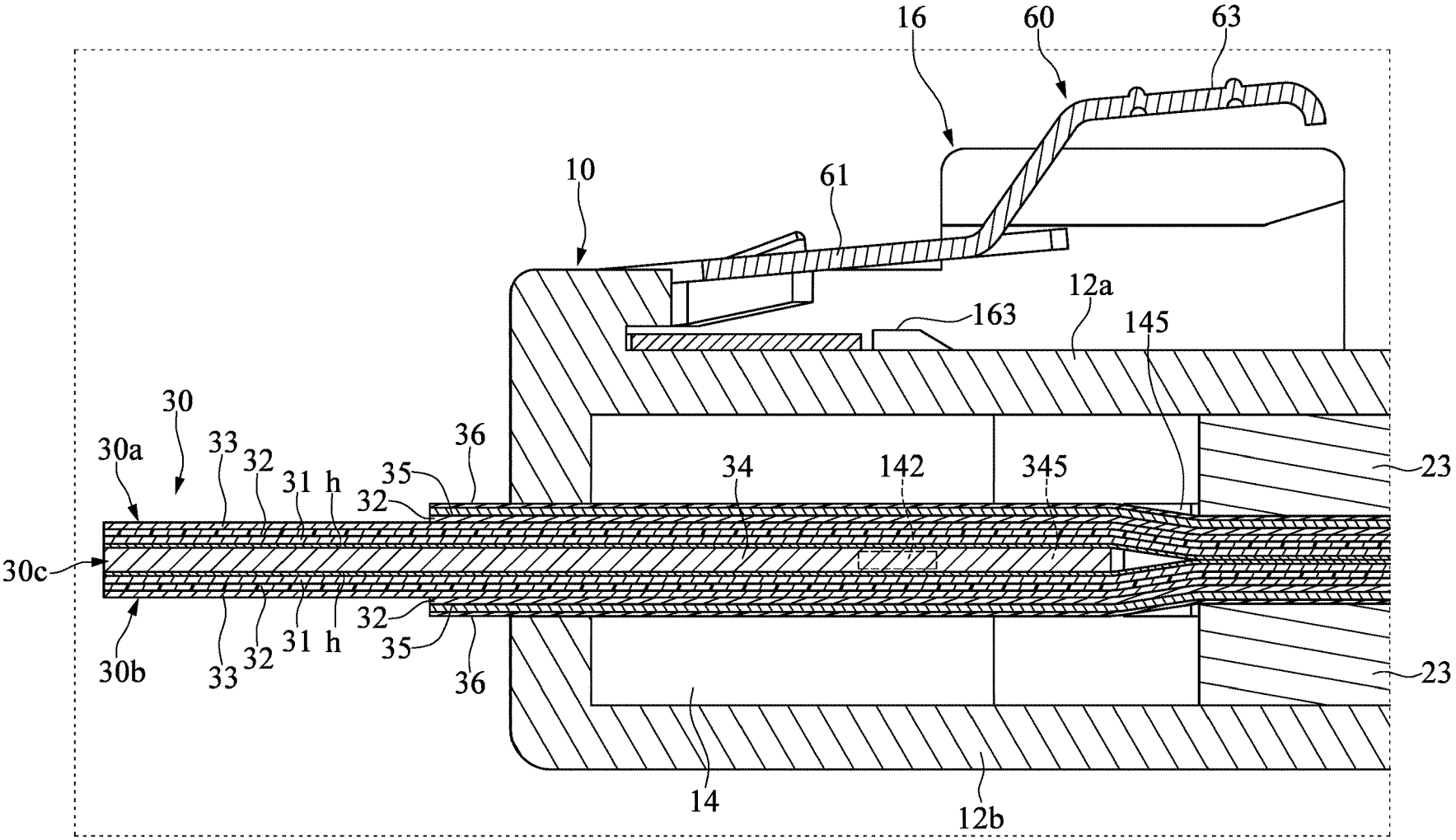
FIG. 3 is a partial enlarged cross-sectional view of the plug connector assembly of the present disclosure.

Reference is made to FIG. 6 and FIG. 7. To fix the flexible flat cable assembly 30 in the insulated housing 10*a*, the reinforced board 30*c* has two positioning plates 345, 346 respectively protruding outward from two sides thereof. In addition, the insulated housing 10*a* forms a displacement-preventing mechanism on an inner side thereof toward the receiving space 120 for blocking the positioning plates 345, 346 of the reinforced board 30*c*, so as to limit the displacement of the reinforced board 30*c* along the inserting direction. Concerning the displacement-preventing mechanism, as shown in FIG. 7, the insulated housing 10*a* forms a pair of trenches 140 on the pair of side walls 14 along the inserting direction, respectively. Two positioning plates 345, 346 are disposed in the pair of trenches 140, respectively. The displacement-preventing mechanism of the insulated housing 10*a* includes a first stopper 142 and a second stopper 143. The first stopper 142 and the second stopper 143 protrude inward from the pair of side walls 14 of the insulated housing 10*a* and are disposed in the pair of trenches 140. As shown in FIG. 7, the first stopper 142 and the second stopper 143 respectively abut against two front ends of the positioning plates 345, 346. As shown in FIG. 3, the displacement-preventing mechanism can further include a pair of rear stoppers 145, which are respectively formed in the trenches 140 and abut against the positioning plates 345, 346. The pair of extending walls 23 of the retainer 20*a* abut against two rear ends of the positioning plates 345, 346.

Figure 9:
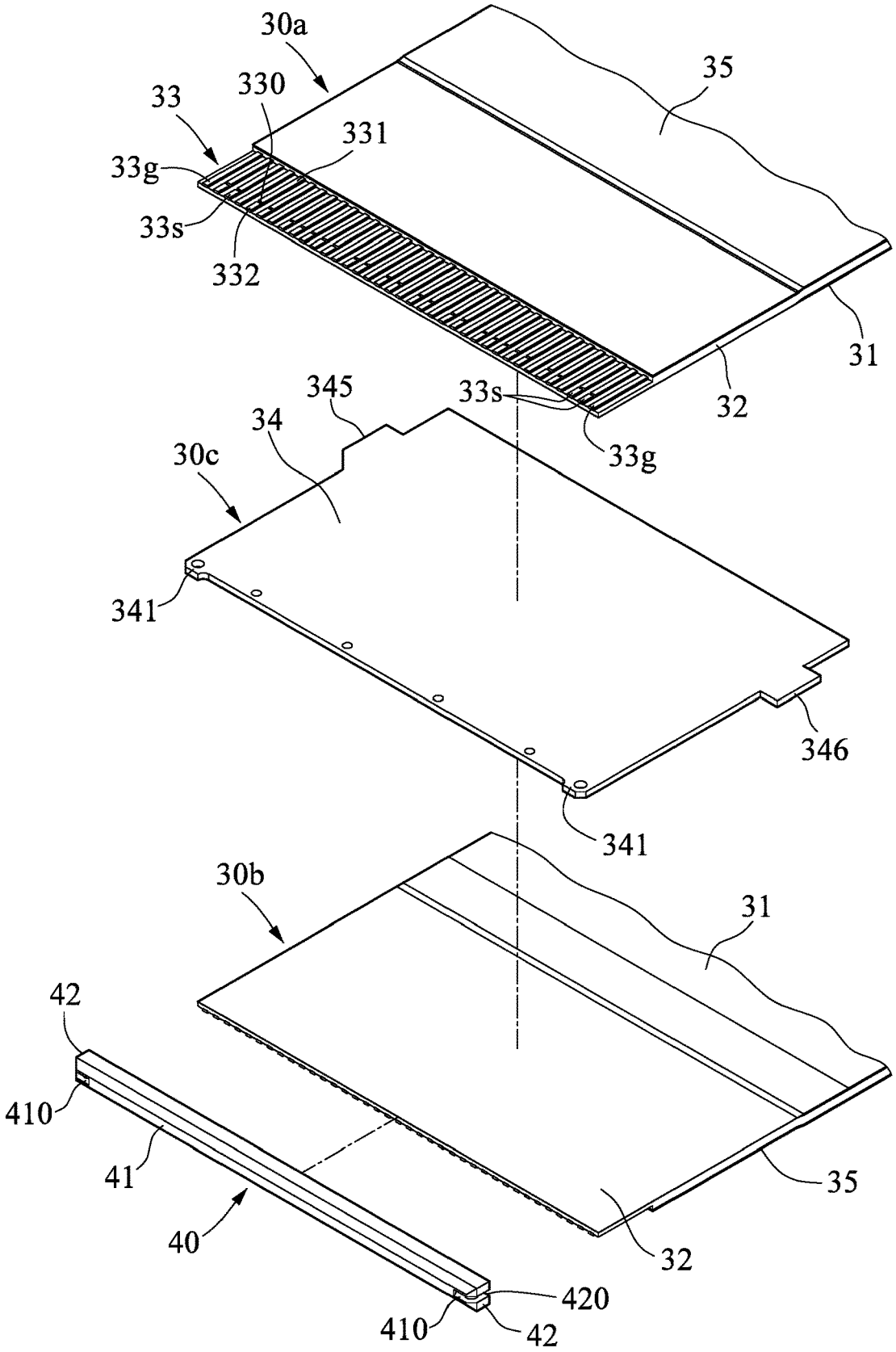
FIG. 9 is an exploded perspective view of the flexible flat cable assembly and a protective member of the present disclosure.

Reference is made to FIG. 7 and FIG. 9. In this embodiment, the positioning plates 345, 346 formed at two sides of the reinforced board 30*c* have different shapes; therefore, it can recognize the top and bottom surfaces of the flexible flat cable assembly 30. The positioning plate 345 forms a beveled edge 3451 at a front end thereof. The positioning plate 346 forms a straight edge 3461 at a front end thereof.

Figure 8:
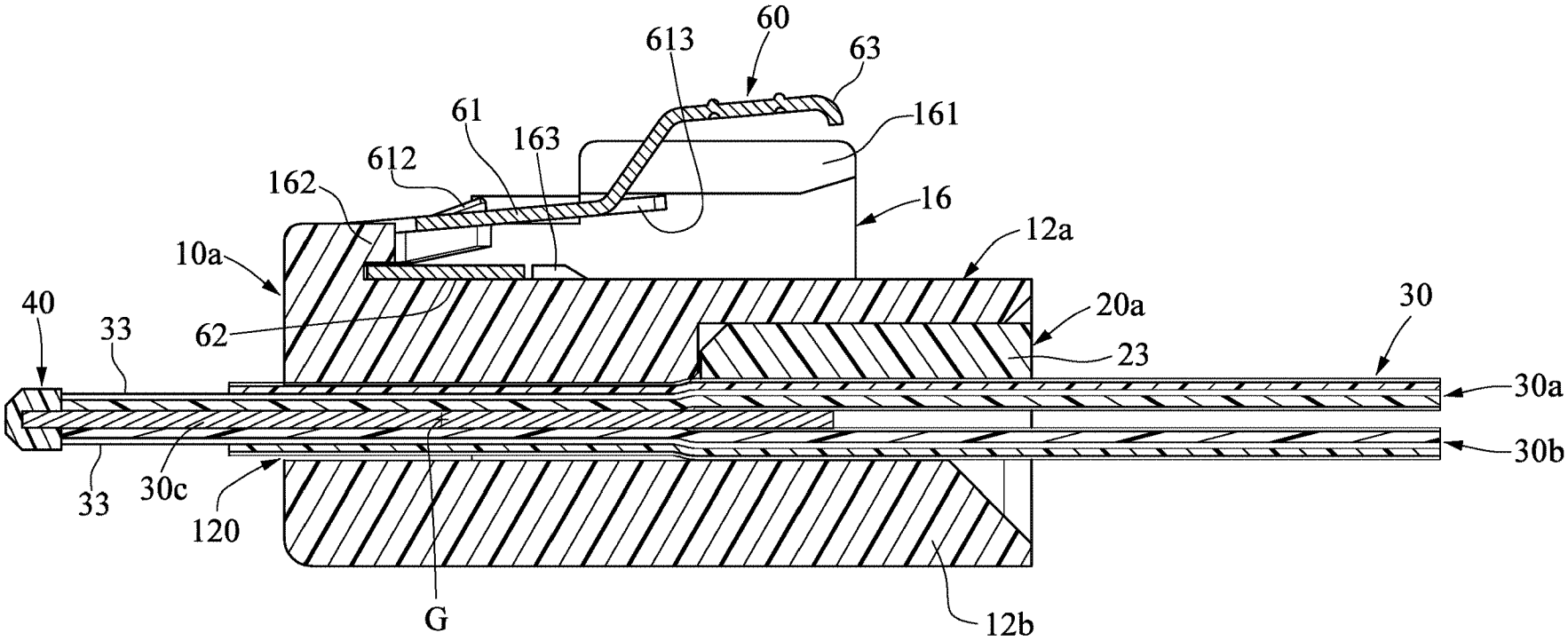
FIG. 8 is a cross-section view along the line VIII-VIII in FIG. 4 of the present disclosure.

Reference is made to FIG. 8. The present disclosure further has one main feature that the protective member 40 clips a front edge of the reinforced board 30*c*. The top and bottom surfaces of the protective member 40 juts from the conductors 33 of the first flat cable 30*a* and the conductor 33 of the second flat cable 30*b*, respectively. Therefore, when the plug connector assembly 1 is inserted into a socket (not shown), such structure can protect the conductors 33 of the flexible flat cable assembly 30 from being directly scraped by the terminals of the socket (not shown) or the metal shell. In this embodiment, the protective member 40 is preferably made of insulated material. The protective member 40 and the reinforced board 30*c* can be taken as a strengthened unit.

Reference is made to FIG. 5 and FIG. 8. The handle 60 is fixed to the top wall 12*a* of the insulated housing 10*a*, and includes an operation portion 63 extending upward. The handle 60 includes a buckling protrusion 62, a top plate 61, and a cutout portion 610. The front end of the top plate 61 is bent and connected to the buckling protrusion 62. The cutout portion 610 is formed at a front end of the top plate 61 and at a front end of the buckling protrusion 62. The handle 60 can be formed from a metal board by a punching technique. The buckling protrusion 62 of the handle 60 is fixed to the top wall 12*a* of the insulated housing 10*a*.

Reference is made to FIG. 5. To fix the handle 60 in place, a mounting structure is formed on the top wall 12*a* of the insulated housing 10*a*. The mounting structure 16 includes a pair of limiting walls 161, a front fixing protrusion 162 and a pair of rear fixing protrusions 163. The front fixing protrusion 162 is formed at a front edge of the top wall 12*a*, and extends rearwardly into the cutout portion 610 of the handle 60 to press against the front edge of the buckling protrusion 62 of the handle 60. The pair of rear fixing protrusions 163 are formed on the top wall 12*a* and arranged behind the front fixing protrusion 162, so as to block the buckling protrusion 62, and prevent the handle 60 from being loosened rearward. A pair of restricting protrusions 613 extends rearward from the top plate 61 of the handle 60, and the pair of limiting walls 161 blocks the pair of restricting protrusions 613. Therefore, the mounting structure 16 limits the forward, rearward and upward displacement of the handle 60. As shown in FIG. 8, a center G of a length of the reinforced board 30*c* along the inserting direction is located behind an opened front edge of the insulated housing 10*a*. In other words, a length of the reinforced board 30*c* in the insulated housing 10*a* is larger than a length of the reinforced board 30*c* exposed outside the insulated housing 10*a*. The operation portion 63 is located above the positioning plates 345, 346 of the reinforced board 30*c* and extends rearward beyond a rear edge of the reinforced board 30*c*. When a force or torque is exerted upon the reinforced board 30*c*, such design can increase the stability of the reinforced board 30*c*.

Figure 10:
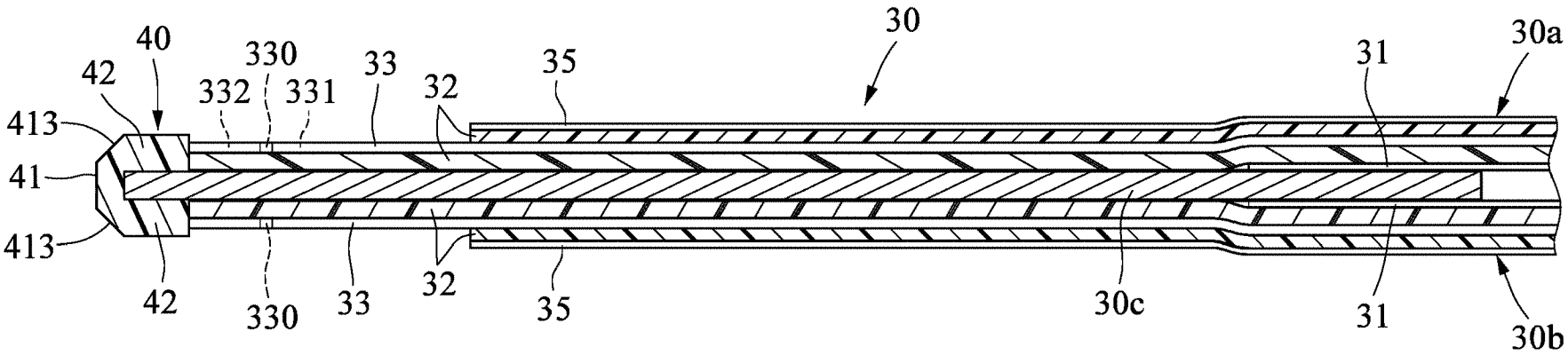
FIG. 10 is a cross-sectional view of the flexible flat cable assembly of the second embodiment and the protective member of the present disclosure.

Reference is made to FIG. 9 and FIG. 10, which is an exploded perspective view and a partial cross-sectional view of the flexible flat cable assembly of the first embodiment. In this embodiment, the first and second flat cables 30*a*, 30*b* of the flexible flat cable assembly 30 have identical structures. However, the present disclosure is not limited thereto. For example, the two flat cables can have different quantities of conductors. The first flat cable 30*a* and the second flat cable 30*b* respectively includes an insulated containing layer 32, an outer shielding layer 35, and an inner shielding layer 31. The conductors 33 are fixed to the insulated containing layer 32. The outer shielding layer 35 is attached to an outer side of the insulated containing layer 32, which can be used to shield external electromagnetic interference. The inner shielding layer 31 is attached to an inner side of the insulated containing layer 32, which can be used to shield another flat cable from electromagnetic interference. The inner shielding layer 31 electrically contacts with the reinforced board 30*c* so as to form a circuit loop. In practice, a conductive paste can be used to bond the reinforced board 30*c* with the first flat cable 30*a* or the second flat cable 30*b*, so as to form a complete shielding effect by electrically contacting the inner shielding layer 31 with the reinforced board 30*c*.

Reference is made to FIG. 5 and FIG. 9. The combination manner of the protective member 40 and the reinforced board 30*c* can be through an in-mold injection molding process. First, the reinforced board 30*c* is disposed in a mold (not shown), and insulated material is injected into the mold to form the protective member 40. Then, the flexible flat cable assembly 30 is assembled with the reinforced board 30*c*. However, the present disclosure is not limited thereto. For example, the protective member 40 can be attached to the reinforced board 30*c* by an adhering process. In detail, the protective member 40 includes a front guiding portion 41 and a pair of protective walls 42. The pair of protective walls 42 are parallel and connected to the front guiding portion 41 to form a receiving slot 420. The front guiding portion 41 includes at least two through slots 410. The through slots 410 pass through the front guiding portion 41 and communicate with the receiving slot 420. The front guiding portion 41 further forms a pair of chamfered surfaces 413. In addition, to increase the combination strength of the reinforced board 30*c* and the protective member 40, two protruding ears 341 protrude from a front edge of the main portion 34. A notch 342 is formed between the two protruded ears 341. Further, a plurality of connection holes 343 are formed along the front edge of the main portion 34. Therefore, during the injection molding process of the protective member 40, the plastic material of the protective member 40 is filled in the connection holes 343 of the reinforced board 30*c* in a clamping manner. After the protective member 40 is combined with the reinforced board 30*c*, a front end of the front guiding portion 41 is flush with the protruded ear 341.

Reference is made to FIG. 10. After the reinforced board 30*c* is combined with the protective member 40, the protective member 40 clamps the front edge of the reinforced board 30*c*. The top and the bottom surfaces of the protective member 40 respectively jut from the conductors 33 of the first flat cable 30*a* and the conductors 33 of the second flat cable 30*b*.

Reference is made to FIG. 9 and FIG. 10. The first flat cable 30*a* and the second flat cable 30*b* respectively include a plurality of signal conductors 33*s* and a plurality of non-signal conductors 33*g*. The non-signal conductors 33*g* are hereby referred to as conductors which are not used to transmit signals, and includes grounding or power-transmitting conductors. Specifically, one feature of this embodiment is that a distance between the signal conductors 33*s* and the protective member 40 is larger than a distance between the non-signal conductors 33*g* and the protective member 40. For example, the above-mentioned two distances have a difference of at least 0.5 mm. If there is electric arcing, the electric arc is first transmitted to the non-signal conductor, for example the grounding conductor, and will not be transmitted to the signal conductor, wherein the signal conductor 33*s* is used to transmit high-frequency signal, and the non-signal conductor 33*g* is used to transmit electrical power or for grounding. The present disclosure therefore can prevent the conductors or elements of the equipment from being damaged by the electrical arcing occurred by the point discharge during hot-plugging. Therefore, the structure provides a design of different contact sequence. In detail, when the plug connector assembly 1 is unmated, the signal conductors 33*s* first depart from the terminals of the socket (not shown). At this time, the non-signal conductors 33*g* are still in contact with the terminals of the socket connector (not shown). In the meantime, if there is electric arcing, the electric arc is firstly transmitted to the non-signal conductor 33*g*, for example, the grounding conductor, and will not be transmitted to the signal conductor 33*s*.

One practical implementation of this embodiment is that, the signal conductor 33*s* of the first and second flat cables 30*a*, 30*b* further forms a slit 330, a transmitting portion 331, and an isolated conductor 332. The isolated conductor 332 is located between the protective member 40 and the slit 330. A width of the slit 330 along the inserting direction could be larger than 0.1 mm, and can be formed by laser cutting. Even if the protective member 40 cannot fully protect the signal conductor 33*s* and the terminals of the matched connector from impact, because of the different contact sequence, such structure has protective functions. The isolated conductors 332 originally belong to the signal conductors 33*s*, and are not electrically contacted with other elements due to the slits 330 formed by laser cutting. The signal conductors 33*s* use the transmitting portions 331 to transmit signals, and the length of the transmitting portion 331 is smaller than the length of the non-signal conductor 33*g*.

Third Embodiment

Figure 11:
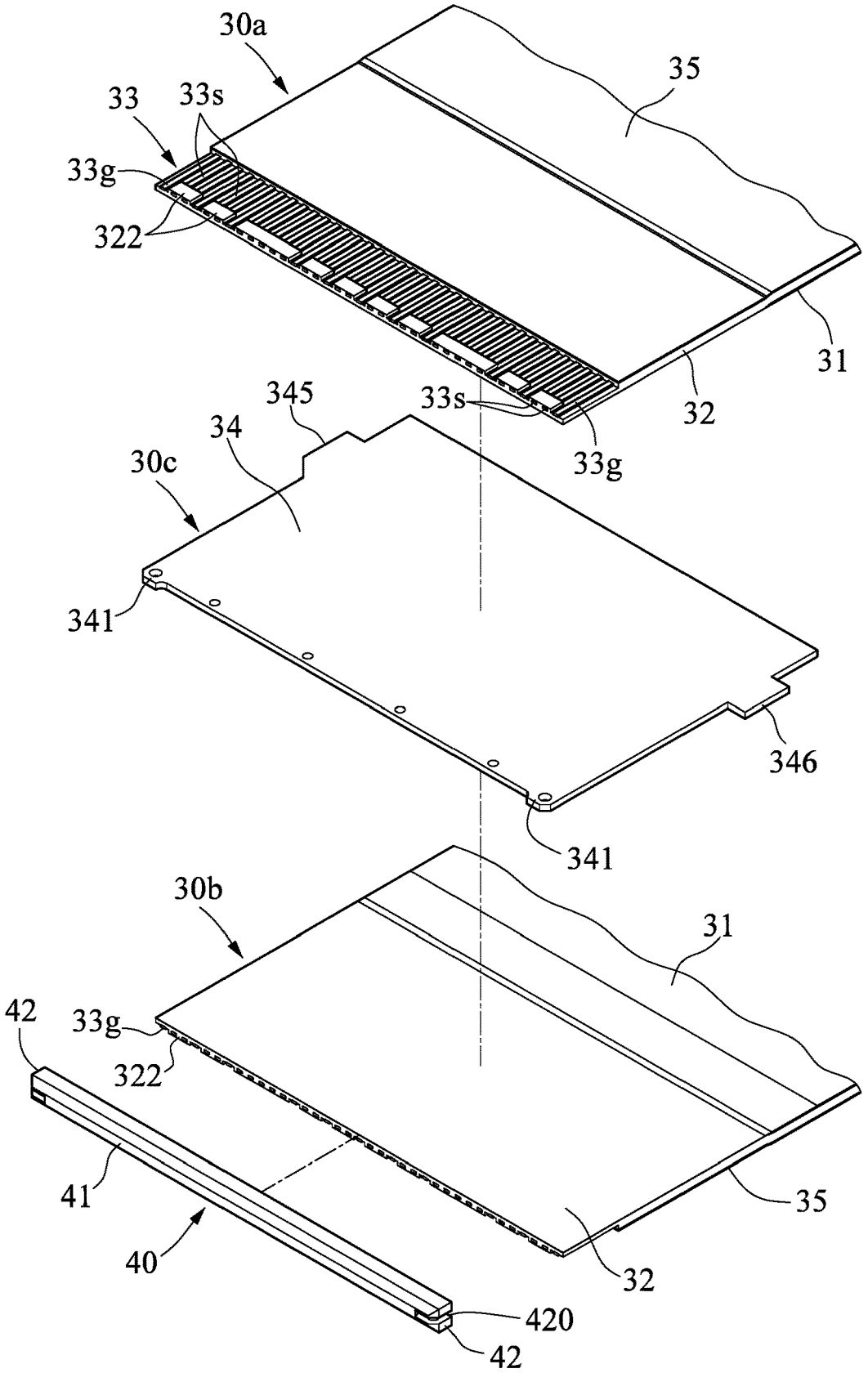
FIG. 11 is an exploded perspective view of the flexible flat cable assembly and the protective member of the present disclosure.
Figure 12:
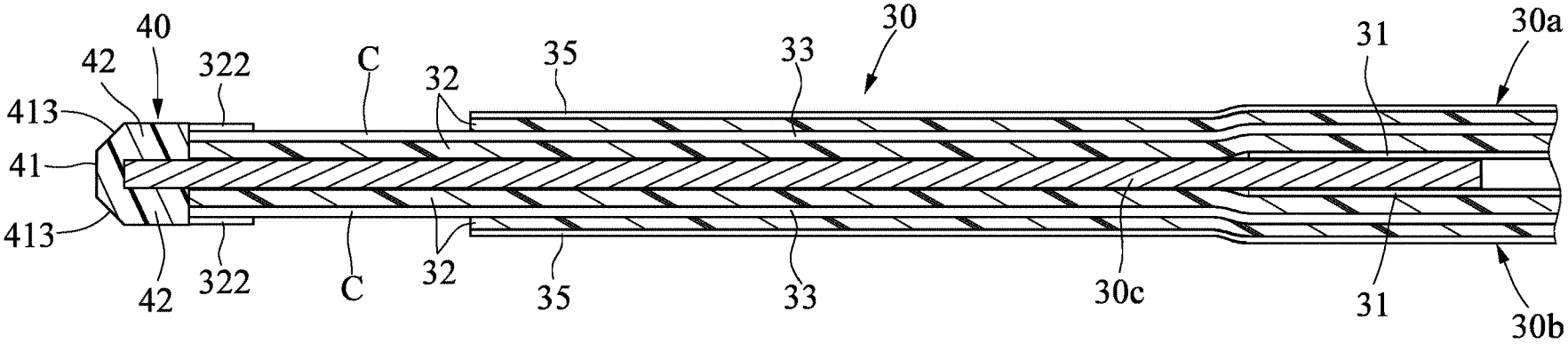
FIG. 12 is a cross-sectional view of the flexible flat cable assembly and the protective member of the present disclosure.

Reference is made to the FIG. 11 and FIG. 12, which are an exploded perspective view and a partial cross-sectional view of the flexible flat cable assembly of the present disclosure. The main difference between this embodiment and the above embodiments is that, the first flat cable 30*a* and the second flat cable 30*b* further have a plurality of covering portions 322. The covering portions 322 are close to the protective member 40, and cover correspondingly the signal conductors 33*s*, so that a distance between the signal conductor 33*s* and the protective member 40 is larger than a distance between the non-signal conductors 33*g* and the protective member 40. The covering portion 322 can be made of insulated material, which can be a part of the insulated containing layer 32. For example, it can be formed during the process of an automatic pressing line for manufacturing the flexible flat cable. However, the present disclosure is not limited thereto, for example, the covering portion 322 can cover the front end of the signal conductor 33*s* with additional insulated material.

Figure 13:
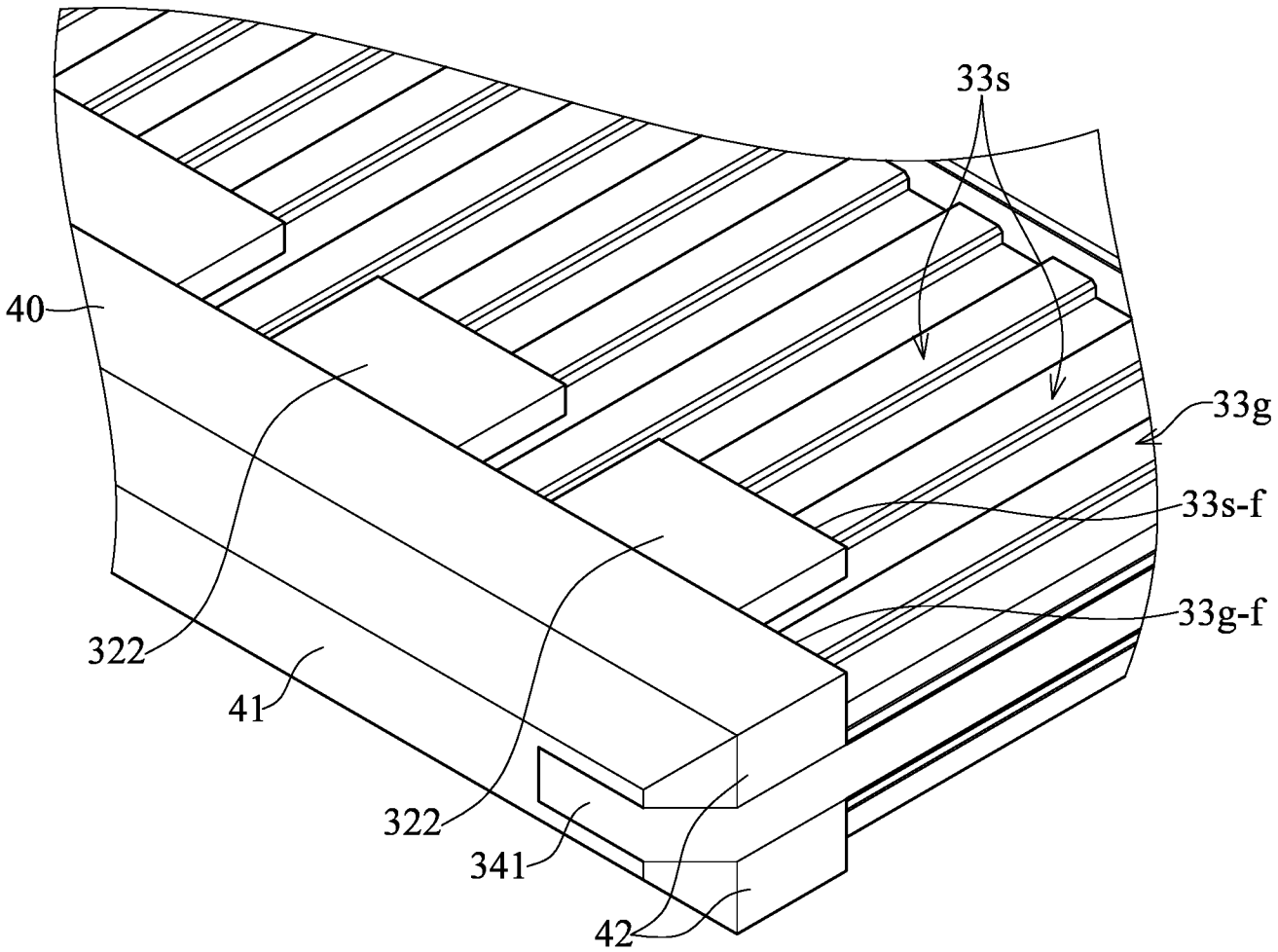
FIG. 13 is an assembled perspective view of the flexible flat cable assembly of a third embodiment and the protective member of the present disclosure.

Reference is made to FIG. 13, which is an assembled perspective view of the flexible flat cable assembly and the protective member of the third embodiment of the present disclosure. The signal conductor 33*s* in this embodiment can be a differential signal conductor. The covering portions 322 cover the front ends of the signal conductor 33*s*. Therefore, the front edge (33*s-f*) of the contacting portion of the differential signal conductor (33*s*), which is formed on the uncovered contacting end of the flexible flat cable, is arranged behind the front edge (33*g-f*) of the contacting portion of the grounding conductor (33*g*). One side of the covering portion 322 is close to the contacting portion of the grounding conductor 33*g*. One side of the covering portion 322 has grounding conductors 33*g* without any covering, so that a distance between the front edge (33*s-f*) of the contacting portion of the differential signal conductor (33*s*) and the front edge of the first flat cable 30*a* is larger than a distance between the front edge (33*g-f*) of the contacting portion of the grounding conductor (33*g*) and the front edge of the first flat cable 30*a*. In other words, the conductors 33 of the first flat cable 30*a* or the second flat cable 30*b* includes at least one grounding conductor (33*g*), and at least one pair of differential signal conductors (33*s*). Therefore, the conductors 33 of this embodiment could have different lengths according to the design requirements, so that the front edges of differential signal conductors (33*s*) are located behind the front edge of the grounding conductor (33*g*), to fulfill the design requirement of different contact sequence. The signal conductor is used to transmit high-frequency signal, and the non-signal conductor is used to transmit electrical power or for grounding. If there is electric arcing, the electric arc is first transmitted to the non-signal conductor, and will not be transmitted to the signal conductor. The present disclosure therefore can prevent the conductors or elements of the equipment from being damaged by the electrical arcing occurred by the point discharge during hot-plugging.

Figure 14A:
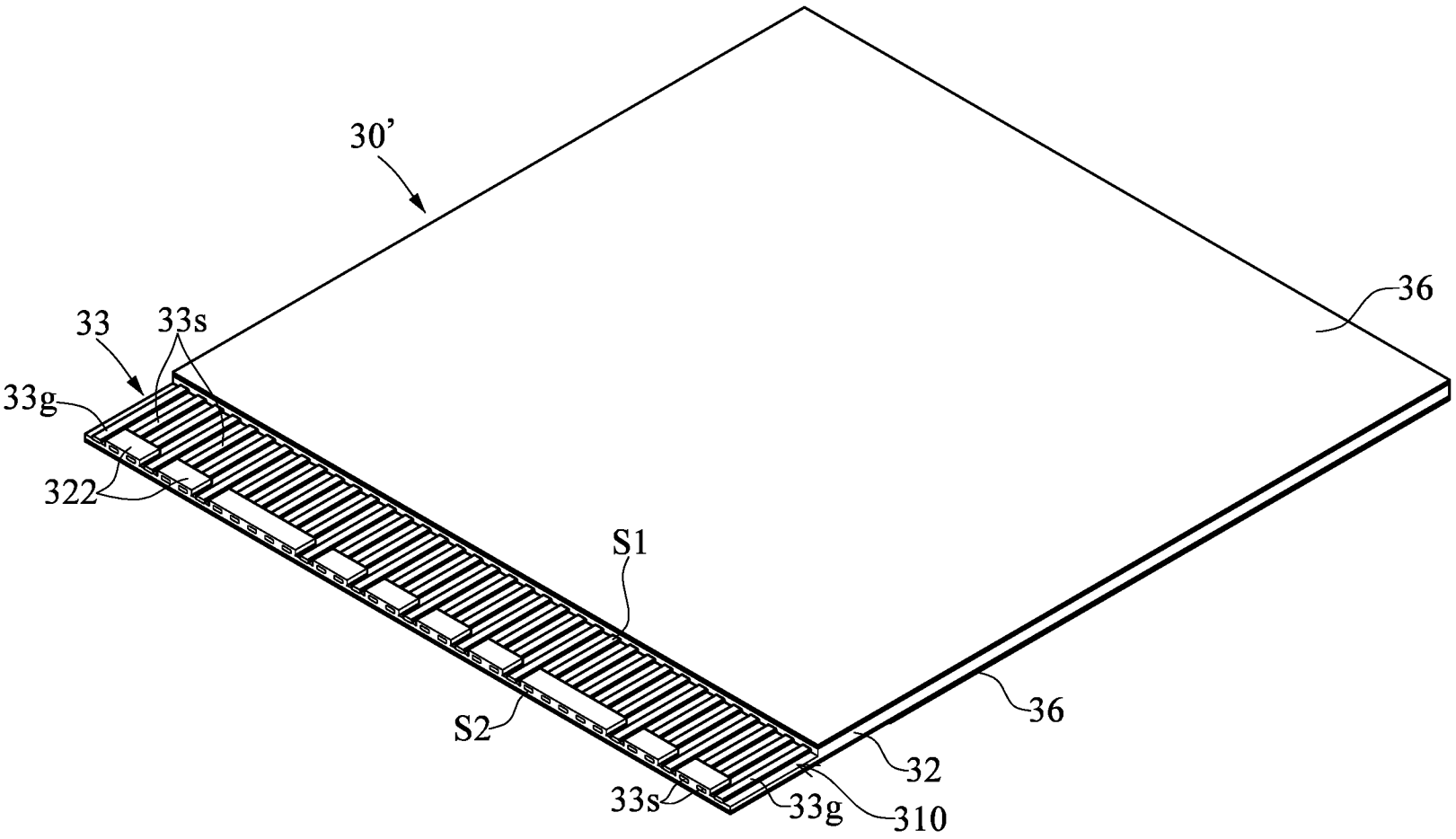
FIG. 14A is a perspective view of the flexible flat cable assembly with a single layer of the present disclosure.
Figure 14B:
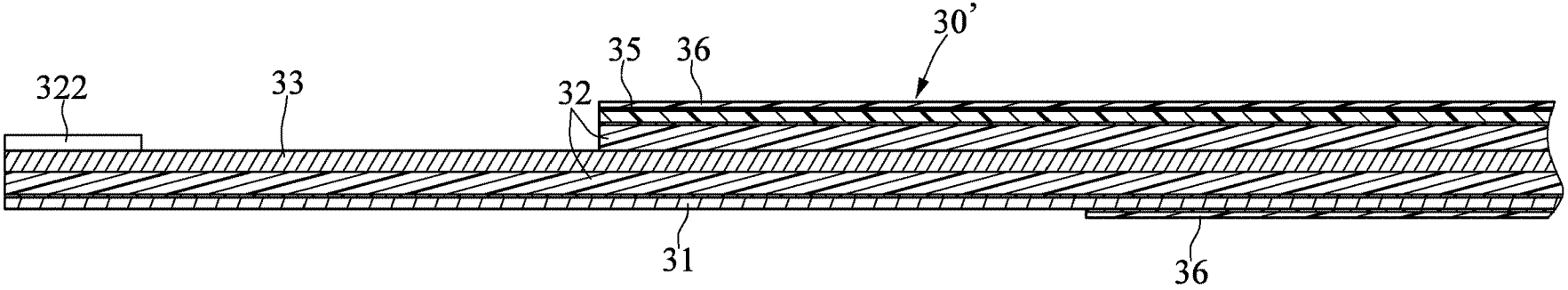
FIG. 14B is a side view of the flexible flat cable assembly of single layer of the present disclosure.

Reference is made to FIG. 14A and FIG. 14B, which is a perspective view and a side view of the flexible flat cable assembly of single layer of the present disclosure. The flexible flat cable of the present disclosure can provide a design of different contact sequence, and can cooperate with the terminals of the connector. The flexible flat cable 30' can be a flat cable of single layer, which is similar to the first flat cable 30*a* or the second flat cable 30*b*, and is disposed on a reinforced board (30*c*, as shown in FIG. 12), for example, on a top surface thereof. Correspondingly, the front edge of the reinforced board can be equipped with a protective member. In addition, according to the embodiment of single-layer flat cable, the bottom surface of the protective member can be flush with the bottom surface of the reinforced board. For example, one front guiding portion 41 is combined with one protective wall 42. The signal conductors 33*s* of the flexible flat cable 30' respectively include a contacting surface (S1) which is uncovered on one end of the flexible flat cable 30', and an embedded surface (S2) which is carried by the insulated containing layer 32. The inner shielding layer 31 has an uncovered portion 310 which is exposed from one side of the flexible flat cable related to the contacting surface (S1) of the contacting portion C, without any protective layer. The flexible flat cable 30' has an insulating layer 36 covered on a bottom thereof as a protective layer.

Figure 15:
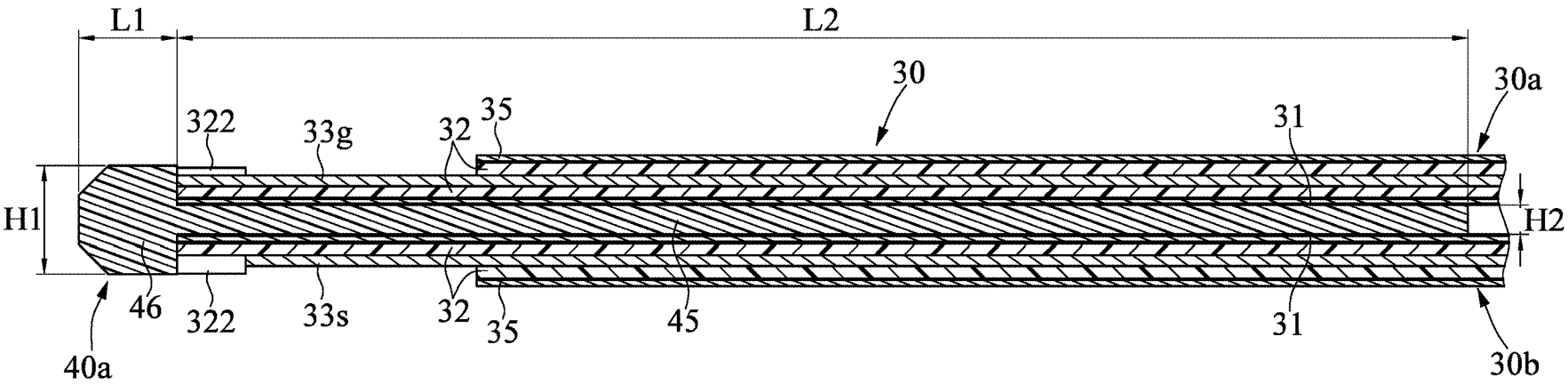
FIG. 15 is another cross-sectional view of the flexible flat cable assembly with a protective member of the third embodiment of the present disclosure.

FIG. 15 is another cross-sectional view of the flexible flat cable assembly and the protective member of the third embodiment. The present disclosure can provide an integrated-type strengthened unit 40*a*, which includes a slab-type strengthened portion 45 and a protective portion 46, and preferably is an insulated material. The function of the strengthened portion 45 is the same as the reinforced board of the previous embodiment. The function of the protective portion 46 is the same as the protective member of the previous embodiment. One side of the strengthened portion 45, i.e., the top surface as shown in FIG. 15, is equipped with the first flat cable 30*a*, and the other side, i.e., the bottom surface as shown in FIG. 15, is equipped with the second flat cable 30*b*. The protective portion 46*a* is integrally connected to the strengthened portion 45. The top surface of the protective portion 46 is exceeded beyond the conductors 33 of the first flat cable 30*a*. The bottom surface of the protective portion 46 is exceeded beyond the conductors 33 of the second flat cable 30*b*. In other words, in this embodiment, the reinforced board and the protective member can be constituted of two pieces, or can be integrated as one strengthened unit, and the manufacturing process can be simplified by cooperating different processes. From another perspective view, in this embodiment, a length L2 of the strengthened portion 45 along the inserting direction is larger than a length L1 of the protective portion 46 along the inserting direction. A height H1 of the protective portion 46 perpendicular to the inserting direction is larger than a height H2 of the strengthened portion 45 perpendicular to the inserting direction. Corresponding to the integrated strengthened unit of this embodiment, the first flat cable 30*a* includes an insulated containing layer 32, an outer shielding layer 35, and an inner shielding layer 31. The insulated containing layer 32 carries a plurality of conductors 33. The outer shielding layer 35 is disposed on an outer side of the insulated containing layer 32. The inner shielding layer 31 is disposed on an inner side of the insulated containing layer 32. The front edge of the inner shielding layer 31 is exceeded beyond or flushed to the front edge (33*s-f*) of the contacting portion of the differential signal conductor (33*s*).

Figure 16:
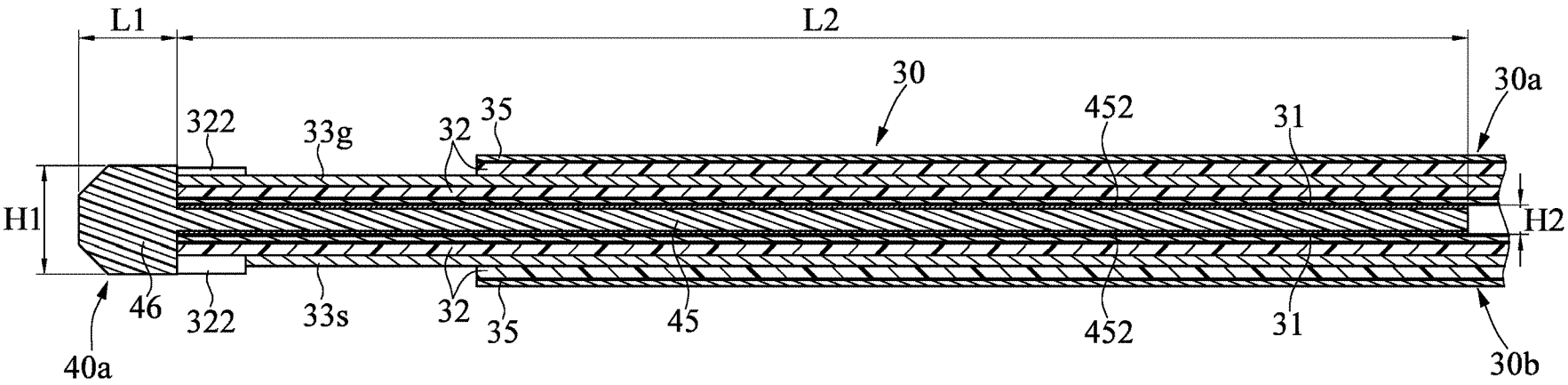
FIG. 16 is a cross-sectional view of the flexible flat cable assembly with the protective member of a fourth embodiment of the present disclosure.

For further explanation, as shown in FIG. 16, when the strengthened portion 45 is made of non-metal material, the strengthened portion 45 of the strengthened unit can further include a metal layer 452, and the metal layer 452 can be formed on the surface of the strengthened portion 45 by a method, for example, an electroplating process. The front edge of the metal layer 452 extends beyond or is flush with the front edge of the contacting portion of the at least one pair of differential signal conductors. The inner shielding layer 31 is disposed on an inner side of the insulated containing layer 32, and one part of the inner shielding layer 31 is electrically contacted with the metal layer 452. The metal layer 452 can provide the shielding function, so as to avoid signal interference. The inner shielding layer 31 can be used to shield another flat cable from electromagnetic interference. The inner shielding layer 31 can be combined with the strengthened portion 45 by conductive paste, and provides a complete shielding effect by electrically connecting the inner shielding layer 31 with the strengthened portion 45.

To sum up, the present disclosure provides the plug connector assembly, which uses the conductors of flat cable to electrically connect terminals of a socket connector, which can simplify the manufacturing process and achieve the impedance matching. The shielding characteristics of flat cable benefits the transmitting of high-frequency signals. In addition, the reinforced board 30*c* of the flexible flat cable assembly 30 and the insulated housing 10 can retain the flexible flat cable assembly 30 in a cooperative and stable manner. The reinforced board 30*c* can be made of metal board, and has functions of not only shielding, but also enhancing structural strength. The present disclosure can replace conventional edge connectors of printed circuit boards, soldered terminal, or insulation-displacement contact (IDC), and more easily process to achieve impedance matching. In addition, the protective member 40 can protect the conductors of the flexible flat cable assembly 30 during mating and unmating processes. Furthermore, in the present disclosure, a distance between the signal conductor 33*s* and the protective member 40 is larger than a distance between the non-signal conductor 33*g* and the protective member 40, so as to provide a design of different contact sequence. If there is electric arcing, the electric arc is first transmitted to the non-signal conductor, for example the grounding conductor, and will not be transmitted to the signal conductor, wherein the signal conductor 33*s* is used to transmit high-frequency signal, and the non-signal conductor 33*g* is used to transmit electrical power or for grounding. The present disclosure therefore can prevent the conductors or elements of the equipment from being damaged by the electrical arcing occurred by the point discharge during hot-plugging. Therefore, the safety of elements of the equipment can be increased.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A plug connector assembly, comprising:

an insulated housing including a top wall, a bottom wall and a pair of side walls cooperatively surrounding and forming a receiving space therein along an inserting direction;

a flexible flat cable assembly including a first flat cable, a second flat cable, and a reinforced board, the first flat cable and the second flat cable respectively including a plurality of conductors exposed from front ends of the insulated housing; the reinforced board being sandwiched between the first flat cable and the second flat cable, wherein the reinforced board is made of a metal board, and the front edge of the reinforced board extends beyond front edges of the first flat cable and the second flat cable; and a protective member being fixedly disposed on the front edge of the reinforced board, a top surface of the protective member jutting from or being flush with the conductors of the first flat cable, a bottom surface of the protective member jutting from or being flush with the conductors of the second flat cable.

2. The plug connector assembly according to claim 1, wherein a center of a length of the reinforced board along the inserting direction is located behind an opened front edge of the insulated housing, the protective member includes a front guiding portion and a pair of protective walls, the protective walls are connected to the front guiding portion in a parallel manner to form a receiving slot, the front guiding portion includes at least two through slots, the through slots pass through the front guiding portion and communicate with the receiving slot, at least two protruded ears protrude from the front edge of the reinforced board, a notch is formed between the protruded ears, the reinforced board forms a plurality of connection holes, a material of the protective member is filled in the connection holes of the reinforced board in a clamping manner, the notch of the reinforced board is received in the receiving slot of the protective member, the protruded ears of the reinforced board are disposed in the through slot of the front guiding portion.

3. The plug connector assembly according to claim 1, wherein the first flat cable or the second flat cable includes an insulated containing layer, an outer shielding layer, and an inner shielding layer, the conductors are fixed to the insulated containing layer, the outer shielding layer is attached to an outer side of the insulated containing layer, the inner shielding layer is attached to an inner side of the insulated containing layer, and the inner shielding layer connects with the reinforced board so as form a circuit loop.

4. The plug connector assembly according to claim 1, wherein the conductors of the first flat cable or the second flat cable includes a pair of signal conductors and a non-signal conductor, the signal conductor includes an isolated conductor, a slit and a transmitting portion, and a distance from the transmitting portion of the signal conductor to the protective member is larger than a distance from the non-signal conductor to the protective member.

5. The plug connector assembly according to claim 1, wherein the conductors of the first flat cable or the second flat cable respectively have a pair of signal conductors, a non-signal conductor, and a covering portion, and the covering portion is close to the protective member, and is correspondingly covered on a front end of the signal conductor.

6. The plug connector assembly according to claim 1, wherein the reinforced board has two positioning plates respectively protruding from two sides thereof, the insulated housing forms a displacement-preventing mechanism on an inner side thereof toward the receiving space so as to block the positioning plate of the reinforced board, such that the displacement of the reinforced board along the inserting direction is limited.

7. The plug connector assembly according to claim 6, wherein the insulated housing forms a pair of trenches respectively on the pair of side walls along the inserting direction, wherein the displacement-preventing mechanism of the insulated housing includes a first stopper and a second stopper, the first and second stoppers respectively protrude inward from the pair of side walls of the insulated housing and in the pair of trenches, and the first and second stoppers respectively abut against front ends of the two positioning plates.

8. A plug connector assembly, comprising:

an insulated housing including a top wall, a bottom wall and a pair of side walls cooperatively surrounding and forming a receiving space therein; and a flexible flat cable assembly, including a first flat cable, a second flat cable, and a strengthened unit, the first flat cable and the second flat cable respectively includes a plurality of conductors, the conductors being exposed from front end of the insulated housing to form a plurality of contacting portions; the first flat cable further including a covering portion, the conductors of the first flat cable including at least one grounding conductor, and at least one pair of differential signal conductors; wherein the covering portion covers front ends of the differential signal conductors, so that a distance between the front edge of the contacting portion of the differential signal conductor and the front edge of the first flat cable is larger than a distance between the front edge of the contacting portion of the grounding conductor and the front edge of the first flat cable;

wherein the strengthened unit includes a board-shaped strengthened portion and a protective portion, the first flat cable being disposed on one side of the strengthened portion, the second flat cable being disposed on the other side of the strengthened portion, a top surface of the protective portion jutting from or being flush with the conductors of the first flat cable, a bottom surface of the protective portion jutting from or being flush with the conductors of the second flat cable.

9. The plug connector assembly according to claim 8, wherein one side of the covering portion is close to the contacting portion of the grounding conductor.

10. The plug connector assembly according to claim 8, further comprising a handle fixed to the insulated housing, the handle including a bottom plate, a top plate, and a notch, wherein a front end of the top plate is bent and connected to the bottom plate, the notch is formed at a front end of the top plate and a front end of the bottom plate, and the bottom plate of the handle is fixed to the top wall of the insulated housing; a pair of limiting walls is formed at the top wall of the insulated housing, a pair of restricting protrusions extends rearward from the top plate of the handle, and the pair of limiting walls block the pair of restricting protrusions.

11. The plug connector assembly according to claim 8, wherein the protective portion of the strengthened unit is integrally connected to the strengthened portion, the first flat cable further includes an insulated containing layer, an outer shielding layer, and an inner shielding layer, the insulated containing layer carries the conductor, the outer shielding layer is disposed on an outer side of the insulated containing layer, the inner shielding layer is disposed on an inner side of the insulated containing layer, a front edge of the inner shielding layer extends beyond or is flush with a front edge of the contacting portion of the at least one pair of differential signal conductors.

12. The plug connector assembly according to claim 8, wherein the strengthened portion of the strengthened unit includes a metal layer, a front edge of the metal layer extends beyond or is flush with the front edge of the contacting portion of the at least one pair of differential signal conductors, the first flat cable further includes an insulated containing layer, an outer shielding layer, and an inner shielding layer, the insulated containing layer carries the conductor, the outer shielding layer is disposed on an outer side of the insulated containing layer, the inner shielding layer is disposed on an inner side of the insulated containing layer, and a part of the inner shielding layer is electrically connected to the metal layer.

13. The plug connector assembly according to claim 8, wherein the strengthened portion of the strengthened unit has two positioning plates respectively protruding outward from two sides thereof, an inner side of the insulated housing forms a displacement-preventing mechanism toward the receiving space to block the positioning plates of the strengthened portion, the displacement-preventing mechanism of the insulated housing includes a first stopper and a second stopper, the first and second stoppers are proximate to a front edge of the insulated housing, and contact the front ends of the two the positioning plates, respectively.

14. The plug connector assembly according to claim 13, wherein the insulated housing includes a pair of trenches respectively formed on the pair of side walls along the inserting direction, the displacement-preventing mechanism further has a pair of rear stoppers respectively, and the rear stoppers are formed in the trenches and abut against the positioning plates.

15. A flexible flat cable for a plug connector assembly, the plug connector assembly including an insulated housing and a flexible flat cable assembly, the flexible flat cable assembly including a flat cable, the flat cable being disposed on a reinforced board, a protective member being disposed on a front edge of the reinforced board, the flexible flat cable being used to form the flat cable, the flexible flat cable comprising:

an insulated containing layer, and a plurality of conductors, the insulated containing layer covering the conductors, the conductors being exposed from an end of the flexible flat cable so as to form a contacting portion, the contacting portion including a contacting surface and an embedded surface, the embedded surface being carried in the insulated containing layer; the conductors including a pair of differential signal conductors and a grounding conductor;

wherein the insulated containing layer includes a covering portion, and the covering portion covers a front end of the differential signal conductor, so that a distance between a front edge of the contacting portion of the differential signal conductor and a front edge of the flexible flat cable being larger than a distance between a front edge of the grounding conductor and a front edge of the flexible flat cable; and an outer shielding layer disposed on a top side of the insulated containing layer, and an inner shielding layer disposed on a bottom side of the insulated containing layer;

wherein the outer shielding layer and the inner shielding layer respectively have an insulated layer on an outer side thereof.

16. The flexible flat cable according to claim 15, wherein each of the conductors has a width of 0.25 to 0.3 mm, and a matching value of differential pair impedance is 100 ohms.

17. The flexible flat cable according to claim 15, wherein each the conductors has a width of 0.3 to 0.5 mm, a matching value of differential pair impedance is 80 ohms.

18. The flexible flat cable according to claim 15, wherein one side of the covering portion is close to the contacting portion of the grounding conductor.

19. The flexible flat cable according to claim 15, wherein the front edge of the inner shielding layer and the insulated layer at an outer side extends beyond or is flush with the front edge of the contacting portion of the differential signal conductor.

20. The flexible flat cable according to claim 15, wherein a part of the inner shielding layer is close to a front edge of the inner shielding layer and does not cover the insulated layer.

* * * * *